US007497809B1

(12) United States Patent
Steams et al.

(10) Patent No.: US 7,497,809 B1
(45) Date of Patent: Mar. 3, 2009

(54) EXERCISE METHODS AND APPARATUS WITH ELLIPTICAL FOOT MOTION

(76) Inventors: Kenneth W. Steams, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 11/981,953

(22) Filed: Oct. 31, 2007

Related U.S. Application Data

(60) Provisional application No. 60/918,298, filed on Mar. 15, 2007.

(51) Int. Cl.
*A63B 22/06* (2006.01)
*A63B 22/04* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS 5,562,574 A * 10/1996 Miller ..... 482/51
5,577,985 A * 11/1996 Miller ..... 482/52
5,611,756 A * 3/1997 Miller ..... 482/52
6,248,046 B1 * 6/2001 Maresh et al. ..... 482/57

* cited by examiner

*Primary Examiner*—Steve R Crow

(57) ABSTRACT

An exercise apparatus includes a frame configured to rest on a floor surface; left and right rocker links pivotally mounted on the frame; left and right reciprocating links having forward ends rotatably coupled to respective rocker links, and rearward ends constrained to move in reciprocal fashion relative to the frame; left and right cranks rotatably mounted on the frame; left and right drive links having forward ends rotatably coupled to respective cranks, and rearward ends rotatably coupled to respective left and right foot links. The foot links have forward ends rotatably coupled to respective rocker links. Intermediate portions of the reciprocating links support rearward portions of respective drive links for both rotational and translational movement relative thereto. The resulting linkage assemblies constrain rearward ends of the foot links to move through elliptical paths, and the paths may be altered by adjusting various components of the linkage assemblies relative to one another and/or the frame.

6 Claims, 1 Drawing Sheet

EXERCISE METHODS AND APPARATUS WITH ELLIPTICAL FOOT MOTION

CROSS-REFERENCE TO RELATED APPLICATIONS

Disclosed herein is subject matter that is entitled to the filing date of U.S. Provisional Application No. 60/918,298, filed Mar. 15, 2007.

FIELD OF THE INVENTION

The present invention relates to exercise methods and apparatus, and more specifically, to exercise equipment that guides a person's feet through generally elliptical paths of motion.

BACKGROUND OF THE INVENTION

Exercise equipment has been designed to facilitate a variety of exercise motions. For example, treadmills allow a person to walk or run in place; stepper machines allow a person to step or climb in place; bicycle machines allow a person to pedal in place; and still other machines allow a person to ski and/or stride in place.

Yet another type of exercise equipment has been designed to facilitate relatively more complicated exercise motions and/or to better simulate the human striding motion. This equipment typically uses a linkage assembly to convert a relatively simple motion, such as circular, into a relatively more complex motion, such as elliptical. Examples of these elliptical motion exercise machines are disclosed in U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; U.S. Pat. No. 5,882,281 to Stearns et al.; U.S. Pat. No. 6,080,086 to Maresh et al.; and U.S. Pat. No. 6,454,682 to Kuo, all of which are incorporated herein by reference to help provide context for better understanding of the subject invention.

SUMMARY OF THE INVENTION

Generally speaking, the present invention provides novel linkage assemblies and corresponding exercise apparatus that facilitate coordinated total body exercise. On a preferred embodiment, a frame is configured to rest on a floor surface, and left and right cranks are rotatably mounted on the frame. Left and right drive links have forward ends that are rotatably coupled to respective cranks, and rearward ends that are rotatably coupled to rearward portions of respective left and right foot links. Opposite, forward ends of the foot links are rotatably coupled to the lower ends of respective left and right rocker links. The rocker links have intermediate portions that are rotatably mounted on the frame. Left and right reciprocating links have forward ends that are rotatably coupled to lower portions of the rocker links, and opposite, rearward ends that are constrained to move through respective reciprocal paths relative to the frame. Left and right rollers are rotatably mounted on intermediate portions of respective reciprocating members to support respective left and right drive links for both rotational and translational movement relative thereto. The resulting linkage assemblies constrain rearward ends of the foot links to move through elliptical paths, and the paths may be altered by adjusting various components of the linkage assemblies relative to one another and/or the frame. Additional features and/or advantages of the present invention will become apparent from the more detailed description that follows.

DETAILED DESCRIPTION OF THE PREFERRED EMBODIMENT

Figure 1:
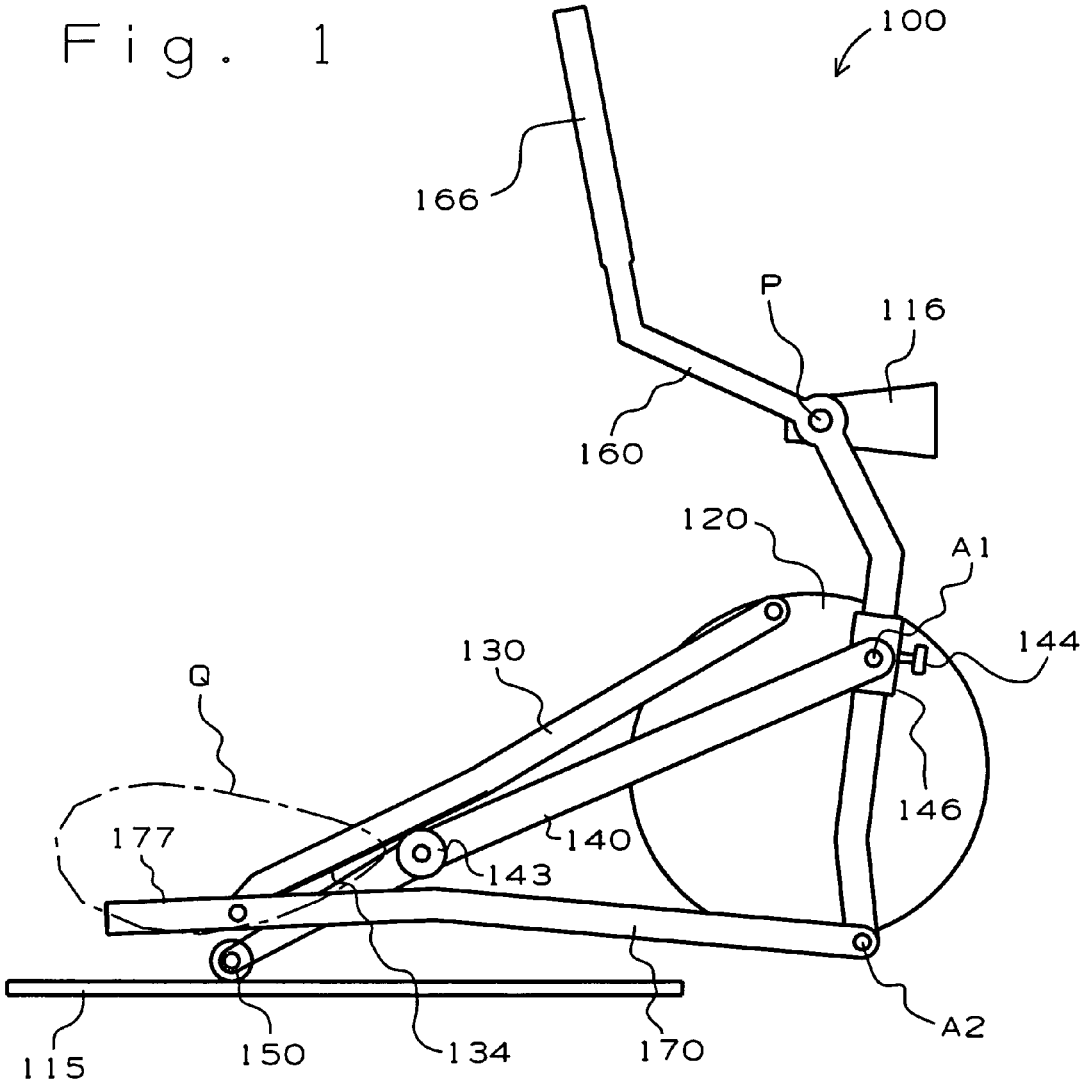
FIG. 1 is a diagrammatic side view of an elliptical motion exercise apparatus constructed according to the principles of the present invention.

The present invention involves elliptical motion exercise machines, and methods that link so-called "elliptical motion" of left and right foot supports to rotation of left and right cranks and/or arcuate motion of left and right handlebars. The term "elliptical motion" is intended in a broad sense to describe a closed-loop path of motion having a relatively longer, major axis and a relatively shorter, minor axis (which extends perpendicular to the major axis).

A preferred embodiment of the present invention is designated as 100 in FIG. 1. The exercise apparatus 100 may be described in terms of a frame that includes left and right guides or tracks 115 and a forward stanchion member 116. Additional structure (not shown) is interconnected between these components in a manner known in the art to form a frame configured to rest upon a floor surface, and support left and right linkage assemblies relative thereto. The apparatus 100 is generally symmetrical about a vertical plane extending lengthwise through the frame, and for ease of illustration only the right side linkage assembly is depicted with the understanding that similar left side linkage assembly components are provided, as well, but one hundred and eighty degrees out of phase relative to their right side counterparts. The difference in phase is maintained by constraining left and right cranks 120 to rotate together, while occupying diametrically opposed orientations. Various known inertia altering devices, including flywheels and/or resistance brakes, for example, may be connected to the cranks, either directly or in "stepped-up" fashion using a belt and different diameter drums.

A conventional user interface (not shown) may be mounted on top of the forward stanchion member 116 to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) data transmitted over the internet; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

In addition to a respective crank 120, each linkage assembly also includes a drive link 130 having a forward end that is rotatably coupled to a respective crank 120, and a rearward end that is rotatably coupled to a rearward portion of a respective foot link 170. The rearward end 177 of each foot link 170 is also sized and configured to support the foot of a person, and thus, may be described as a foot platform. An opposite forward end of each foot link 170 is rotatably coupled to the lower end of a respective rocker link 160 (at pivot point A2). An intermediate portion of each rocker link 160 is rotatably mounted on the front stanchion member at a common pivot axis P. An upper end or handle portion 166 of each rocker link 160 is sized and configured for grasping.

Each linkage assembly further includes a reciprocating member 140 having a forward end that is rotatably coupled to a respective adjustment member or sleeve 146 (at pivot axis A1). Each sleeve 146 is slidably mounted on a respective rocker link 160. As a matter of design choice, any of several known means may be used to selectively relocate each sleeve 146 along a respective rocker link 160. For example, as shown in FIG. 1, "ball-detent" push-pins 144 may be inserted through holes in respective sleeves 146 and into any of a plurality of holes disposed along a respective rocker link 160 (at different distances from the pivot axis P). As another example, linear actuators may be interconnected between respective reciprocating links 140 and respective rocker links 160 (in lieu of the pins 144), and placed in operational communication with the optional user interface described above.

Each reciprocating member 140 has a rearward end that is rotatably coupled to a respective roller 150. The rollers 150 are configured and arranged to roll back and forth along respective tracks 115, and each roller 150 may also be described as cooperating with a respective track 115 to constrain an respective rearward end to move in reciprocal fashion relative to the frame.

Left and right rollers 430 are rotatably mounted on intermediate portions of respective left and right reciprocating links 140. Each roller 143 is configured and arranged to roll along a respective downwardly facing guide or track 134 on the rearward portion of a respective drive link 130, and may also be described as cooperating with a respective track 134 to accommodate movement of a respective drive link 130 in both pivotal and translational fashion relative to a respective reciprocating link 140.

In operation, the linkage assemblies constrain the left and right foot platforms 177 to move through elliptical paths. In this regard, a person or user places his feet on respective foot platforms 177, and grasps the handles 166 in his respective hands. By exerting force through the foot platforms 177 and/or the handles 166, the user causes the linkage assemblies to move relative to the frame, and the cranks 120 link movement of the right linkage assembly to movement of the left linkage assembly. When the apparatus 100 is configured as shown in FIG. 1, the pivot axes A1 move through arcuate paths having a relatively small radius (a more curved path for a given amount of fore and aft movement), and the foot platforms 177 travel through elliptical paths Q. When the pivot axes A1 are relocated closer to the pivot axes A2, the pivot axes A1 move through arcuate paths having a relatively greater radius (a less curved path for a given amount of fore and aft movement), and the foot platforms 177 travel through elliptical paths having relatively shorter minor axes. In other words, the step or stride height is adjusted by relocating the pivot axes A1 along respective rocker links 160.

The present invention has been described with reference to specific embodiments and a particular application, with the understanding that persons skilled in the art will derive additional embodiments, improvements, and/or applications that nonetheless fall within the scope of the invention. Among other things, the present invention may also be recited in terms of methods that are performed in making and/or using the embodiments disclosed herein. In any event, the scope of the present invention should be limited only to the extent of the following claims.

What is claimed is:

1. An elliptical motion exercise apparatus, comprising:

a frame configured to rest on a floor surface;

a left crank and a right crank, wherein each said crank is rotatably mounted on the frame;

a left drive link and a right drive link, wherein each said drive link has a forward end, and a rearward end, and each said forward end is rotatably coupled to a respective said crank;

a left rocker link and a right rocker link, wherein each said rocker link is rotatably mounted on the frame at a common pivot axis;

a left reciprocating link and a right reciprocating link, wherein each said reciprocating link has a forward end rotatably coupled to a lower portion of a respective said rocker link, a rearward end constrained to move in reciprocal fashion relative to the frame, and an intermediate portion that supports a rearward portion of a respective said drive link for both rotational and translational movement relative thereto; and a left foot link and a right foot link, wherein each said foot link has a forward end rotatably coupled to a lower portion of a respective said rocker link, and a rearward, foot supporting portion rotatably coupled to the rearward end of a respective said drive link.

2. The apparatus of claim 1, wherein a left roller is rotatably mounted on the intermediate portion of the left reciprocating link and rollable along a guide on the left drive link, and a right roller is rotatably mounted on the intermediate portion of the right reciprocating link and rollable along a guide on the right drive link.

3. The apparatus of claim 2, wherein each said rocker link and a respective said reciprocating link cooperate to define a respective first pivot axis disposed at a first radial distance from the common pivot axis, and each said rocker link and a respective said foot link cooperate to define a respective second pivot axis disposed at a relatively greater, second distance from the common pivot axis.

4. The apparatus of claim 3, wherein each said first pivot axis is selectively movable along a respective said rocker link.

5. The apparatus of claim 3, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

6. The apparatus of claim 1, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

* * * * *